US009160109B2

(12) United States Patent
Mauney et al.

(10) Patent No.: US 9,160,109 B2
(45) Date of Patent: Oct. 13, 2015

(54) LEVER ACTUATED ELECTRICAL CENTER ASSEMBLY

(71) Applicant: Yazaki North America, Inc., Canton, MI (US)

(72) Inventors: Joseph A. Mauney, South Lyon, MI (US); Conrad Naegelin, Canton, MI (US); Chris W. Stock, Wayne, MI (US); Jeffrey L. Liu, Windsor (CA)

(73) Assignee: Yazaki North America, Inc., Canton, MI (US)

( * ) Notice: Subject to any disclaimer, the term of this patent is extended or adjusted under 35 U.S.C. 154(b) by 19 days.

(21) Appl. No.: 14/105,616

(22) Filed: Dec. 13, 2013

(65) Prior Publication Data

US 2015/0171553 A1 Jun. 18, 2015

(51) Int. Cl.
*H01R 13/629* (2006.01)
*H01R 13/627* (2006.01)
*H01R 43/26* (2006.01)

(52) U.S. Cl.
CPC ..... *H01R 13/62977* (2013.01); *H01R 13/6275* (2013.01); *H01R 43/26* (2013.01)

(58) Field of Classification Search
CPC ..... H01R 13/62938; H01R 13/62955; H01R 13/62933; H01R 13/639
See application file for complete search history.

(56) References Cited

U.S. PATENT DOCUMENTS

| | | | | |
|---|---|---|---|---|
| 5,183,408 | A | 2/1993 | Hatagishi | |
| 5,244,400 | A | 9/1993 | Hatagishi | |
| 5,322,448 | A * | 6/1994 | Hahn | 439/157 |
| 5,681,175 | A * | 10/1997 | Busse et al. | 439/157 |
| 5,928,012 | A * | 7/1999 | Kitamura | 439/157 |
| 5,964,602 | A * | 10/1999 | Aoki et al. | 439/157 |
| 6,168,445 | B1 * | 1/2001 | Seutschniker et al. | 439/157 |
| 6,193,530 | B1 | 2/2001 | Sakurai et al. | |
| 6,213,795 | B1 * | 4/2001 | Drescher et al. | 439/157 |
| 6,217,354 | B1 * | 4/2001 | Fencl et al. | 439/157 |
| 6,960,090 | B2 | 11/2005 | Denter et al. | |
| 6,997,725 | B2 | 2/2006 | Stella et al. | |
| 7,037,124 | B2 | 5/2006 | Lee et al. | |
| 7,568,925 | B2 | 8/2009 | Ciriello et al. | |
| 7,695,296 | B1 | 4/2010 | Hitchcock et al. | |
| 7,789,682 | B1 | 9/2010 | Hitchcock et al. | |
| 8,197,270 | B2 | 6/2012 | Vasbinder et al. | |
| 8,235,742 | B2 | 8/2012 | Komiyama et al. | |

(Continued)

FOREIGN PATENT DOCUMENTS

| | | | |
|---|---|---|---|
| EP | 0938162 | A2 | 8/1999 |
| GB | 2300767 | A | 11/1996 |
| WO | 2004093257 | A1 | 10/2004 |

OTHER PUBLICATIONS

European Search Report mailed May 12, 2015 for European Patent Application 14197263.8.

(Continued)

*Primary Examiner* — Gary Paumen
(74) *Attorney, Agent, or Firm* — Harness, Dickey & Pierce, P.L.C.

(57) ABSTRACT

A connector assembly having a first connector portion, which has a lever that is configured to slide a pair of cam track structures, and a second connector portion that includes a plurality of cam followers that are received into cam tracks in the cam track structures. The lever can be operated to draw the first connector portion toward the second connector portion to couple first and second terminals together.

18 Claims, 9 Drawing Sheets

(56) References Cited

U.S. PATENT DOCUMENTS

| | | | | |
|---|---|---|---|---|
| 2003/0022538 | A1 | 1/2003 | Langolf et al. | |
| 2005/0020114 | A1 * | 1/2005 | Denter et al. | 439/157 |
| 2006/0040536 | A1 * | 2/2006 | Putnam et al. | 439/157 |
| 2009/0317993 | A1 * | 12/2009 | Komiyama et al. | 439/157 |
| 2012/0329302 | A1 | 12/2012 | Genta | |

OTHER PUBLICATIONS

Office Action dated May 1, 2015 issued by the IP Australia in Australian Patent Application No. 2014262260.

* cited by examiner

LEVER ACTUATED ELECTRICAL CENTER ASSEMBLY

FIELD

The present disclosure relates to a lever actuated connector assembly that is suited for use in coupling a junction box assembly or electric center to a vehicle electrical system.

BACKGROUND

This section provides background information related to the present disclosure which is not necessarily prior art.

Modern vehicles typically employ a junction box assembly, also known as an electric center, for the central mounting of various electric hardware, such as relays and fuses, in a centralized manner that permits several wire harnesses to be connected the junction box assembly. Prior designs typically included a mounting bracket and a junction box that were coupled together via one or more threaded fasteners. It is desirable, however, to avoid the use of threaded fasteners when possible so that more recent designs have been proposed that employ a single cam, a single slide or double levers. We have found that these designs require a relatively large force to couple the junction box to the bracket and moreover can be rather large in size. Accordingly, an improved connector assembly is needed in the art.

SUMMARY

This section provides a general summary of the disclosure, and is not a comprehensive disclosure of its full scope or all of its features.

In one form, the present teachings provide a connector assembly that includes first and second connector portions. The first connector portion has a first connector housing, a pair of cam track structures and a lever. The first connector housing is configured to support a plurality of first terminals. The cam track structures are slidably coupled to opposite sides of the first connector housing for movement between a retracted position and an extended position. Each of the cam track structures has at least one cam track. The lever is pivotally coupled to the first connector housing for movement between a lowered position and a raised position. The lever is coupled to the cam track structures such that the cam track structures are in the retracted position when the lever is in the lowered position and the cam track structures are in the extended position when the lever is in the raised position. The second connector portion has a second connector housing and a plurality of cam followers. The second connector housing is configured to support a plurality of second terminals. Each of the cam followers is fixedly coupled to the second connector housing and received in a corresponding one of the cam tracks. The cam tracks are configured to cooperate with the cam followers to draw the first connector housing toward the second connector housing when the lever is moved from the raised position to the lowered position. The cam tracks are also configured to cooperate with the cam followers to urge the first connector housing away from the second connector housing when the lever is moved from the lowered position to the raised position.

In another form, the present teachings provide a method for installing a junction box assembly to a vehicle electrical system. The junction box assembly is a first connector portion and has a first connector housing, a pair of cam track structures and a lever. The first connector housing supports a plurality of first terminals. The cam track structures are slidably coupled to opposite sides of the first connector housing for movement between a retracted position and an extended position. Each of the cam track structures has at least one cam track. The lever is pivotally coupled to the first connector housing for movement between a lowered position and a raised position. The lever is coupled to the cam track structures such that the cam track structures are in the retracted position when the lever is in the lowered position and the cam track structures are in the extended position when the lever is in the raised position. The method includes: providing a second connector portion having a second connector housing and a plurality of cam followers; inserting a plurality of wire harness connectors into the second connector housing, each of the wire harness connectors having a plurality of second terminals; pre-staging the junction box assembly to the second connector portion such that the first connector housing is aligned to the second connector housing in a predetermined manner; moving the lever from the lowered position to the raised position to align an insertion portion of each cam track to a corresponding one of the cam followers; and moving the lever from the raised position to the lowered position to drive the first connector housing toward the wire harness connectors and engage the first terminals to the second terminals.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
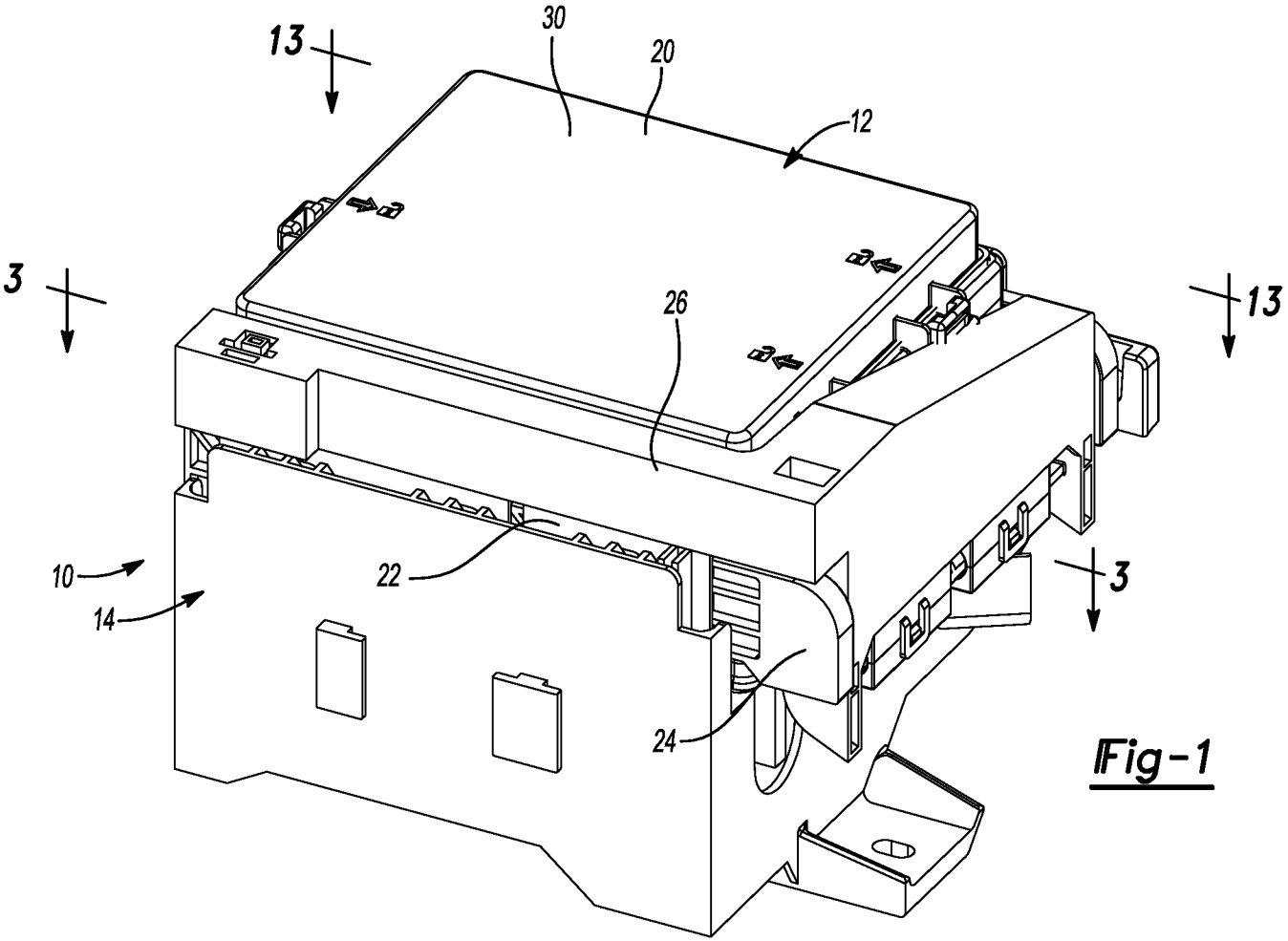
FIG. 1 is a perspective view of an exemplary connector assembly constructed in accordance with the teachings of the present disclosure.
Figure 2:
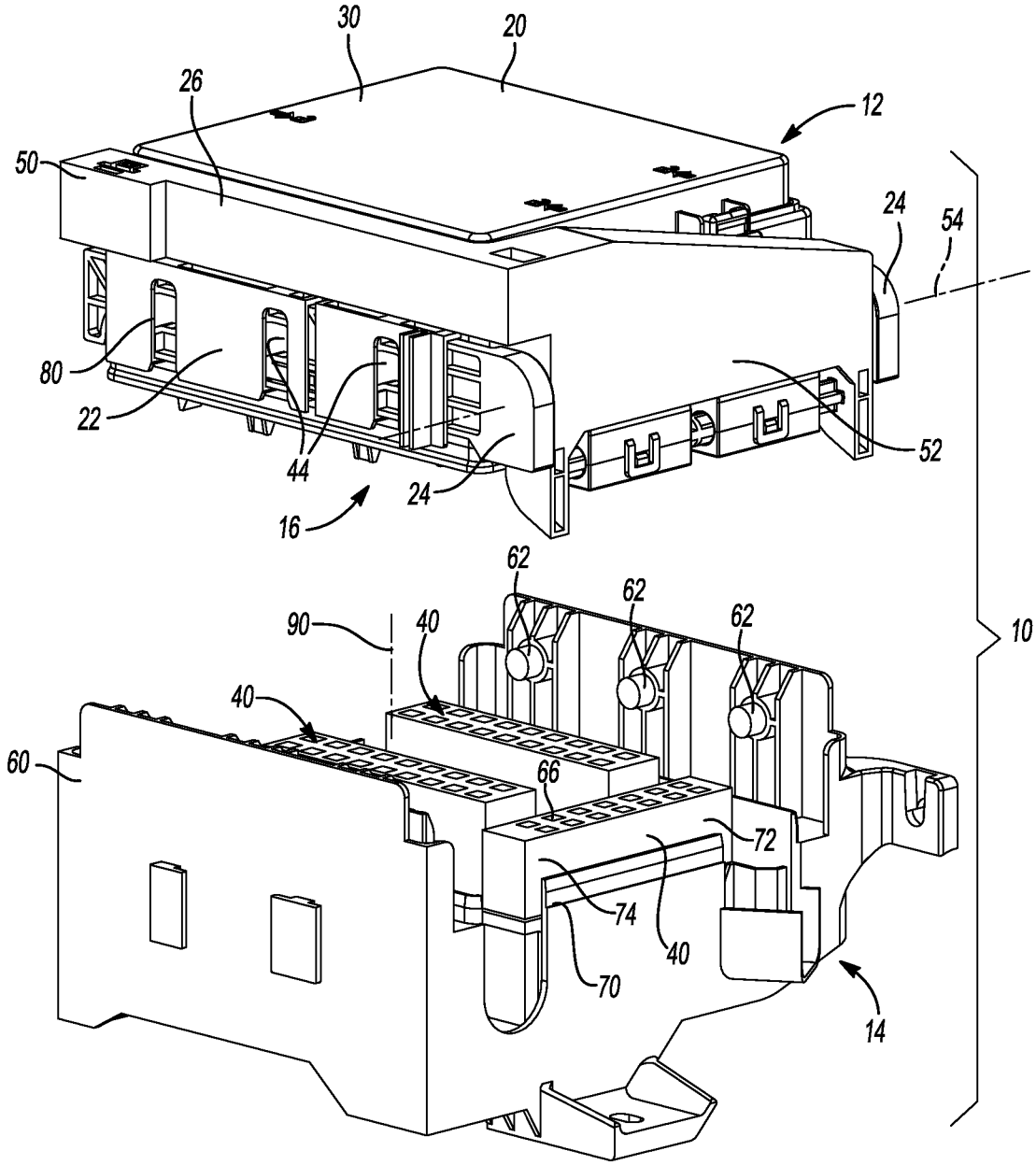
FIG. 2 is an exploded perspective view of the connector assembly of FIG. 1.

With reference to FIGS. 1 and 2, a connector assembly constructed in accordance with the teachings of the present disclosure is generally indicated by reference numeral 10. In the particular example provided, the connector assembly 10 is employed to connect a junction box assembly to a vehicle electrical system, but those of skill in the art will appreciate that the teachings of the present disclosure have application to various other situations and as such, the scope of the present disclosure will not be limited to the particular example described herein and illustrated in the appended drawings. The connector assembly 10 can include a first connector portion 12, a second connector portion 14 and a keying system 16.

Figure 3:
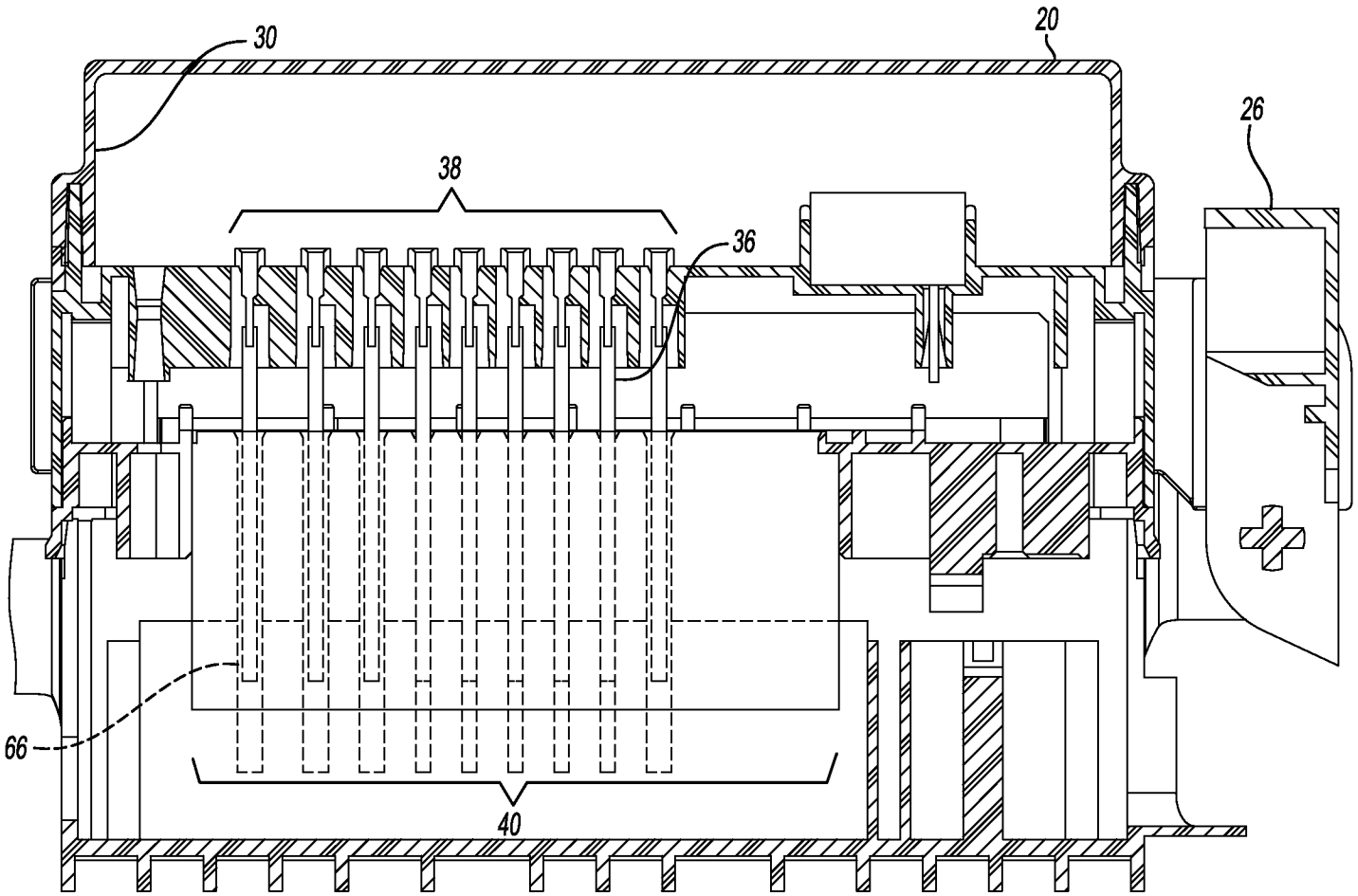
FIG. 3 is a sectional view taken along the line 3-3 of FIG. 1.

With reference to FIGS. 2 and 3, the first connector portion 12 can comprise a junction box assembly 20, a pair of cam track housings 22, a pair of cam track structures 24 and a lever 26. The junction box assembly 20 can include a first connector housing 30 and a plurality of conventional "junction box components" that can include circuit boards, relays, fuses, bus bars, etc. Various elements of the "junction box components" can have terminals (i.e., first terminals 36) that can be coupled to and supported by the first connector housing 30. While the arrangement of the first terminals 36 relative to the first connector housing 30 may be varied in any desired manner, the first terminals 36 in the particular example provided are disposed in a plurality of first terminal sets 38 that are configured to matingly engage corresponding second terminal sets 40 that are associated with the second connector portion 14 as will be described in detail, below. The cam track housings 22 can be coupled to opposite sides of the first connector housing 30 and can define a space in which an associated one of the cam track structures 24 is slidably received. Each of the cam track structures 24 can define one or more cam tracks 44. The lever 26 can include a handle 50 and a yoke 52 that can be pivotally mounted to the first connector housing 30 for pivoting motion about a lever axis 54. The cam track structures 24 can be pivotally mounted to the yoke 52 at a location that is offset from the lever axis 54 such that pivoting of the lever 26 between a lowered position and a raised position will cause corresponding translation of the cam track structures 24 in the cam track housings 22 between a retracted position and an extended position.

The second connector portion 14 can include a mounting bracket or second connector housing 60 and a plurality of cam followers 62. The second connector housing 60 can be configured to be coupled to a plurality of second terminals 66 that are adapted to matingly engage and electrically couple to the first terminals 36. In the example provided, the second connector housing 60 defines a plurality of connector mounts 70, each of which being configured to matingly engage a discrete wire harness connector 72 that terminates an end of an associated wire harness (not shown) and comprises a wire harness connector housing 74 and a plurality of terminals (i.e., second terminals 66 arranged in second terminal sets 40). In the example provided, each connector mount 70 is configured to engage (only) a corresponding one of the wire harness connector housings 74 in a predetermined manner so that the corresponding second terminal set 40 is aligned to the second connector housing 60 in a predetermined manner along three orthogonal axes. Each of the cam followers 62 can be coupled to the second connector housing 60 and configured to engage a corresponding one of the cam tracks 44 on the cam track structures 24. It will be appreciated that the cam tracks 44 and the cam followers 62 can be configured in any desired manner.

Figure 8:
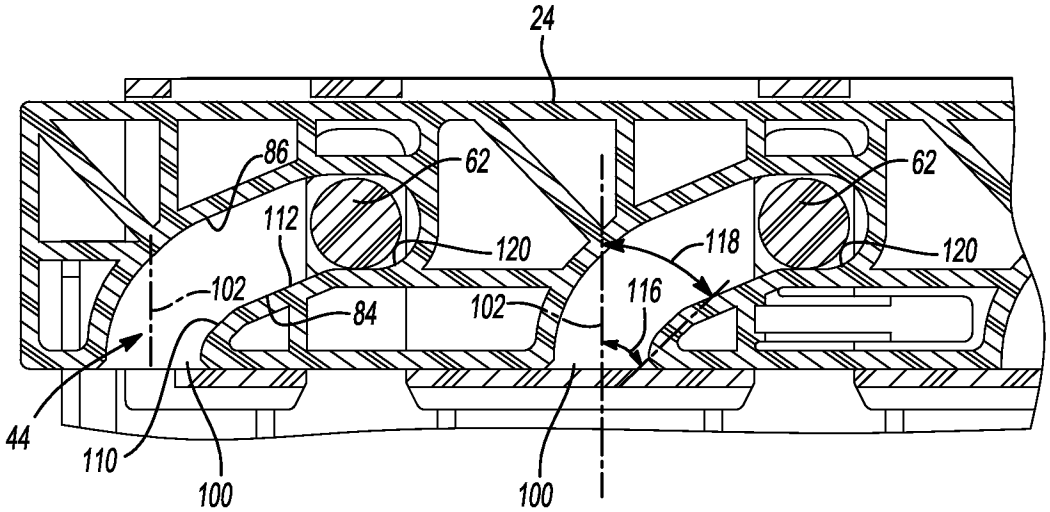
FIG. 8 is a sectional view of a portion of the first connector portion illustrating a cam track structure in more detail.

With reference to FIGS. 2 and 8, the cam followers 62 comprise cylindrical posts that are fixedly coupled to opposite sides of the second connector housing 60, while each of the cam tracks 44 comprises a groove or channel that is configured to receive the cylindrical post of an associated one of the cam followers 62 therein. U-shaped apertures 80 can be formed in the cam track housings 22 to permit the cam followers 62 to be received therethrough and into the cam tracks 44.

Each cam track 44 can have a coupling side 84 and a decoupling side 86. Each of the coupling sides 84 is configured to contact an associated one of the cam followers 62 when the lever is moved from the raised position to the lowered position to move the cam track structures 24 relative to the cam followers 62 in a coupling direction (i.e., along a coupling axis 90) such that the first connector housing 30 is urged toward the second connector housing 60. The decoupling side 86 can be configured in a manner that is similar to the coupling side 84 and as such will not be described in detail herein other than to note that the decoupling side 86 is configured to contact the cam follower 62 when the lever 26 is moved from the lowered position to the raised position to thereby coordinate movement of the cam track structures 24 relative to the cam followers 62 in a direction opposite the coupling direction such that the first connector housing 30 is urged away from the second connector housing 60 along the coupling axis 90.

The coupling side 84 can include an insertion portion 100, which is disposed along an insertion axis 102 and generally parallel to the coupling axis 90, and at least one transition portion that is configured to move the cam track structures 24 relative to the cam followers 62 along the insertion axis 102 as the cam track structures 24 are moved between the extended and retracted positions. In the particular example provided, each coupling side 84 includes a first transition portion 110 and a second transition portion 112. The first transition portion 110 can be a straight segment that can be configured such that a first included angle 116 is disposed between it and the insertion axis 102. The second transition portion 112 can be a straight segment that can be configured such that a second included angle 118 is disposed between it and the insertion axis 102. The first included angle 116 can be smaller than the second included angle 118 and can be positioned relative to the "stroke" of the cam track structures 24 along the insertion axis 102 to contact the cam followers 62 when the first terminals 36 (FIG. 3) begin to engage the second terminals 66 (FIG. 3). Configuration in this manner permits a relatively higher level of force to be exerted on the first terminals 36 (FIG. 3) when they are engaging the second terminals 66 (FIG. 3) and a relatively reduced force on the first terminals 36 when they have been engaged to the second terminals 66 and are being "seated" to the second terminals 66. The coupling sides 84 can terminate at a dwell portion 120 that can be configured to maintain the cam track structures 24 at a desired orientation or position relative to the cam followers 62 along the insertion axis 102 as the lever 26 is moved to toward the lowered position.

Figure 9:
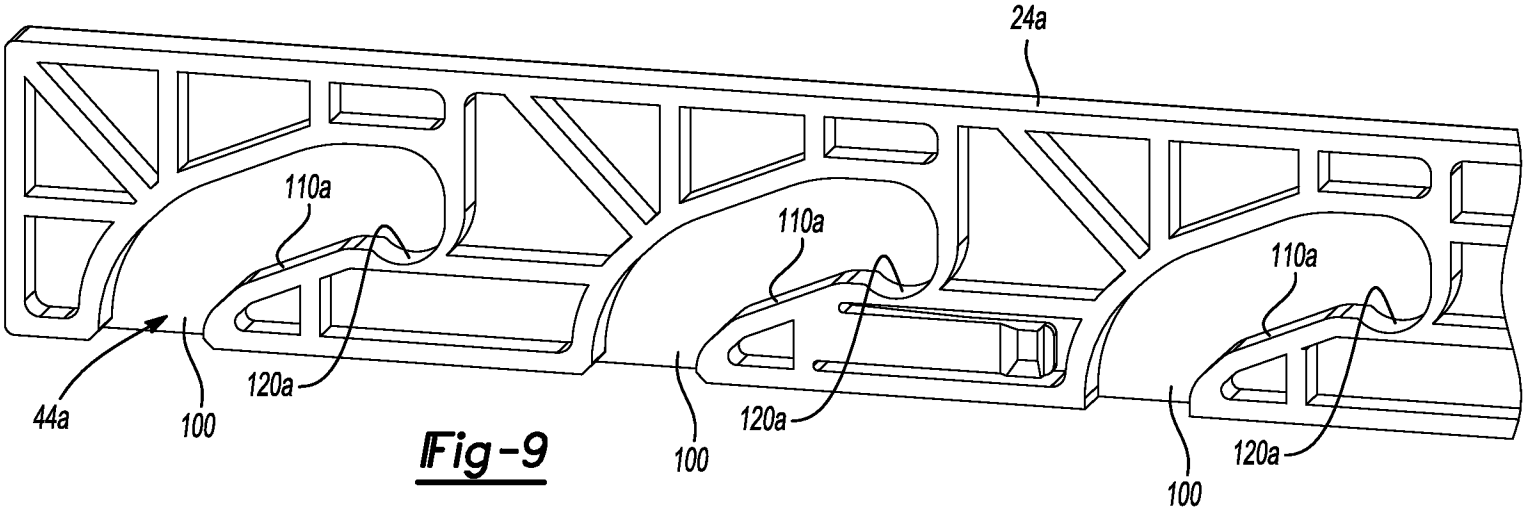
FIG. 9 is a perspective view of an alternately constructed cam track structure.

An alternately constructed cam track structure **24*a* is depicted in FIG. 9. The cam track structure 24*a* defines a plurality of cam tracks 44*a* having a single transition portion 110*a* and terminating at a back-angled portion 120*a*. The single transition portion 110*a* comprises a straight segment that extends between the insertion portion 100 and the back-angled portion 120*a*. The back-angled portion 120*a* is configured to cooperate with the cam followers 62 (FIG. 2) to slightly withdraw the first terminals 36 (FIG. 3) from the second terminals 66 (FIG. 3) as the cam track structures 24***a* are moved into the retracted position. Additionally, the positioning of the cam followers 62 (FIG. 2) at the distal end of the back-angled portion 120*a* tends to lock the cam track structures 24 in the retracted position.

Figure 4:
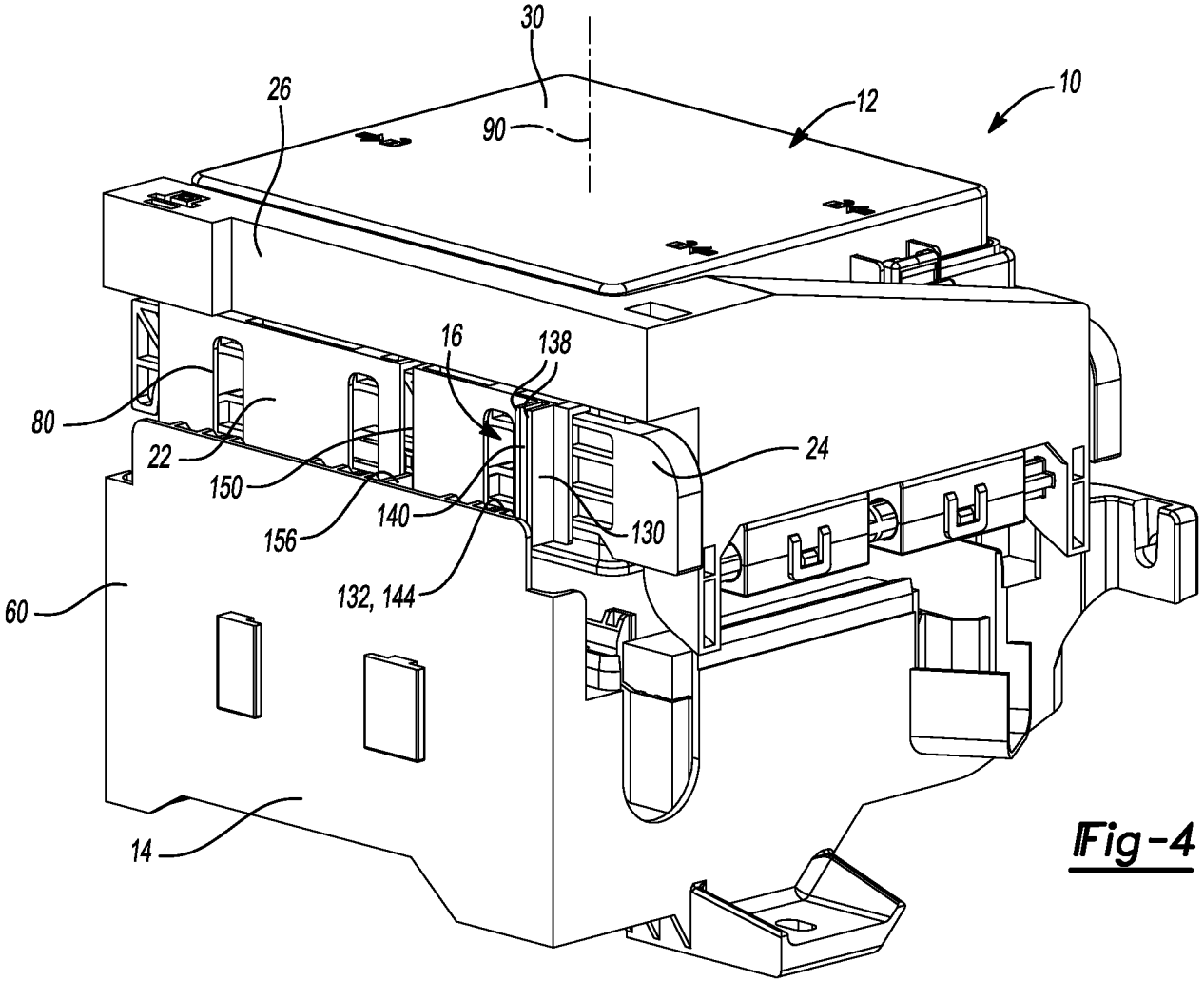
FIG. 4 is a perspective view of the connector assembly of FIG. 1 with first and second connector portions being positioned in a pre-stage position.
Figure 5:
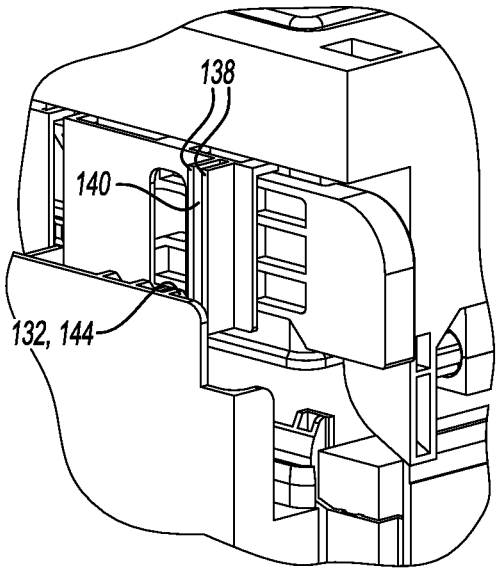
FIG. 5 is an enlarged portion of FIG. 4 illustrating a keying system in more detail.

With reference to FIGS. 4 and 5, the keying system 16 can have a first key member 130, which can be coupled to the first connector portion 12, and a second key member 132 that can be coupled to the second connector portion 14. The keying system 16 is configured to permit the first connector housing 30 to be mated or inserted to the second connector housing 60 only when the first and second key members 130 and 132 are engaged to one another. The first key member 130 can comprise a pair of first ribs 138 that are coupled to one of the cam track housings 22 and cooperate to define a keying groove 140 that extends generally parallel to the coupling axis 90. The second key member 132 can comprise a second rib 144 that can be sized to be received in the keying groove 140 when the first connector housing 30 is aligned to the second connector housing 60 in a predetermined manner. The first and second ribs 138 and 144 can be configured to contact the second connector housing 60 and one of the cam track housings 22, respectively, if the first connector housing 30 is not aligned to the second connector housing 60 in the predetermined manner and an attempt is made to insert the first connector housing 30 to the second connector housing 60.

With reference to FIG. 2, an exemplary method for assembling and coupling the connector assembly 10 to a vehicle electric system will be described. The second connector portion 14 can be coupled to the vehicle electrical system and fixedly secured to a vehicle. In this regard, the several wire harness connectors 72 can be received in the connector mounts 70 such that the wire harness connector housings 74 are fixedly (but removably) mounted to the second connector housing 60 in their predetermined orientations.

In FIGS. 4 and 5, the first connector portion 12 can be mounted to the second connector portion 14 in a pre-stage condition such that the second rib 144 is disposed in the keying groove 140 and the cam followers 62 (FIG. 2) are received in the U-shaped apertures 80 formed in the cam track housings 22. Optionally, the first connector portion 12 can have a lock that cooperates with another portion of the first connector portion 12 to inhibit movement of the cam track structures 24 from the retracted position toward the extended position and/or the lever 26 from the lowered position toward the raised position.

Figure 6:
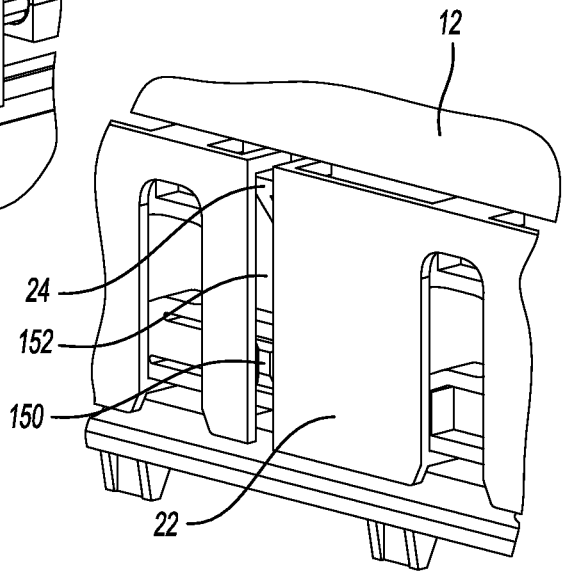
FIG. 6 is an enlarged portion of the first connector portion illustrating a cam track lock in more detail.
Figure 7:
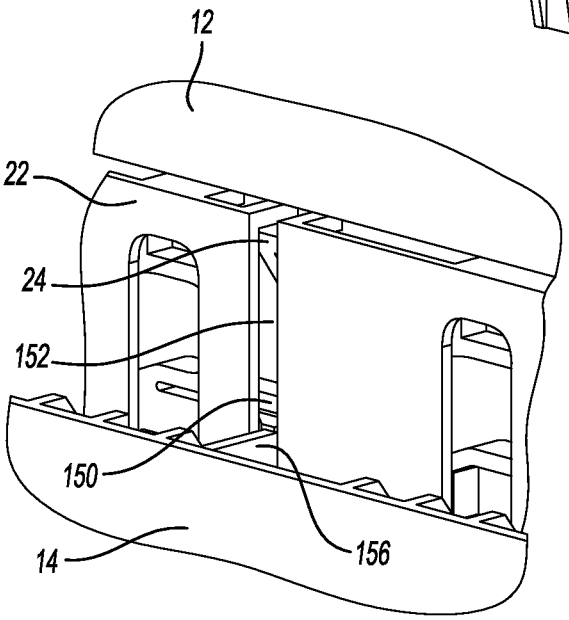
FIG. 7 is an enlarged portion of FIG. 4 illustrating an unlocking member on the second connector portion interacting with the cam track lock on the first connector portion.

With reference to FIGS. 6 and 7, the first connector portion 12 comprises a cam track lock 150 that is formed on one of the cam track structures 24. The cam track lock 150 extends into a slot 152 formed in one of the cam track housings 22 when the cam track structures 24 are disposed in the retracted position. It will be appreciated that contact between the cam track lock 150 and the cam track housing 22 will inhibit movement of the cam track structure 24 toward the extended position, to thereby inhibit movement of the lever 26 (FIG. 4) toward the raised position, as well as corresponding movement of the other one of the cam track structures 24 toward the extended position. The second connector portion 14 can include a rib or unlocking member 156 that can extend through the slot 152 and resiliently urge the cam track lock 150 out of alignment with the side of the cam track housing 22 so that the cam track structures 24 may be moved from the retracted position to the extended position.

It will be appreciated that when the first connector portion 12 is decoupled from the second connector portion 14, contact between the cam track lock 150 and the edge of the slot 152 in the cam track housing 22 will inhibit movement of the cam track structures 24 from the retracted position toward the extended position to thereby inhibit movement of the lever 26 (FIG. 4) from the lowered position toward the raised position. It will further be appreciated that positioning of the first connector portion 12 relative to the second connector portion 14 in the pre-stage position positions the unlocking member 156 in the slot 152 such that the unlocking member 156 resiliently urges the cam track lock 150 out of alignment with the side of the cam track housing 22 so that the cam track structures 24 can be moved toward the extended position.

Figure 10:
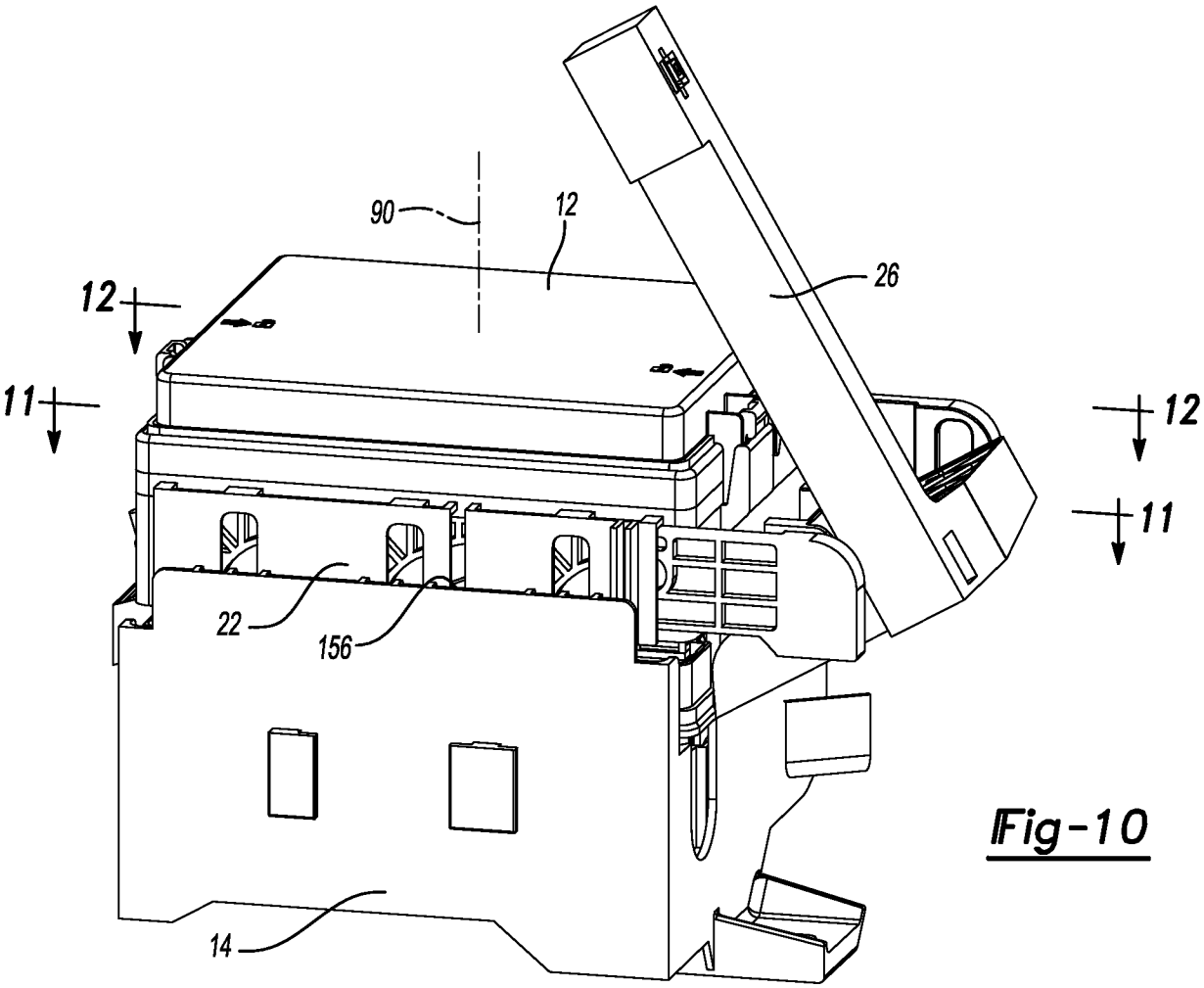
FIG. 10 is a perspective view of the connector assembly of FIG. 1 with the first and second connector portions engaged to one another, a lever of the first connector portion in a raised position and the cam track structures of the first connector portion in an extended position.
Figure 11:
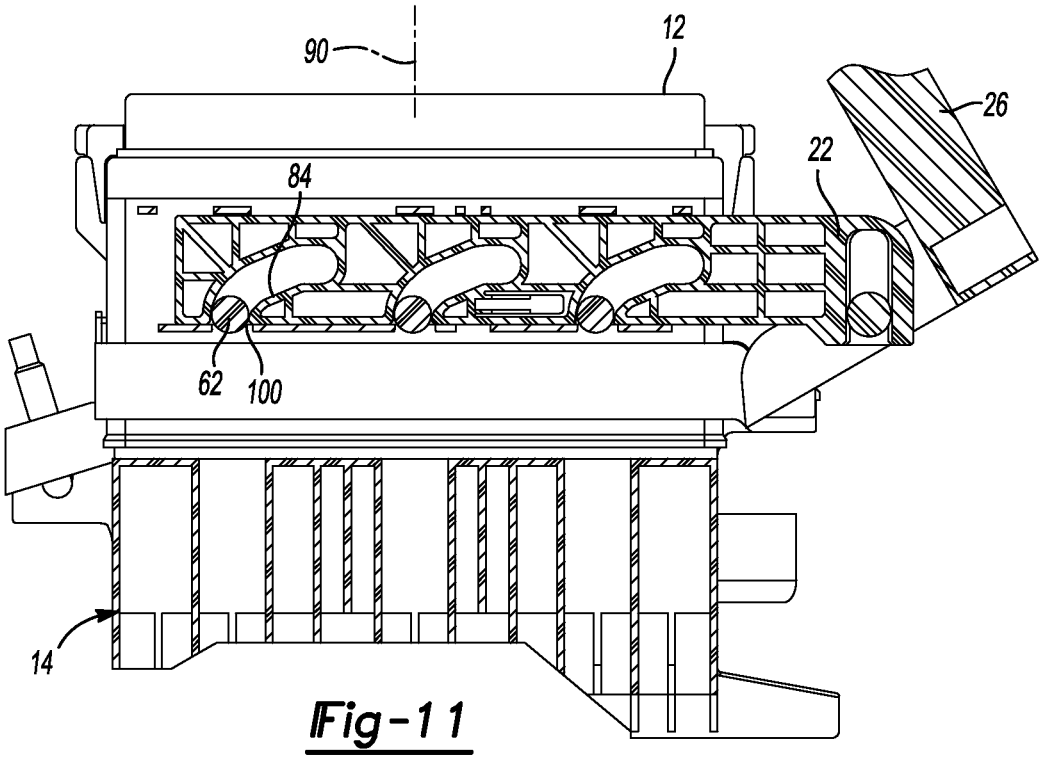
FIG. 11 is a section view taken along the line 11-11 of FIG. 10.
Figure 12:
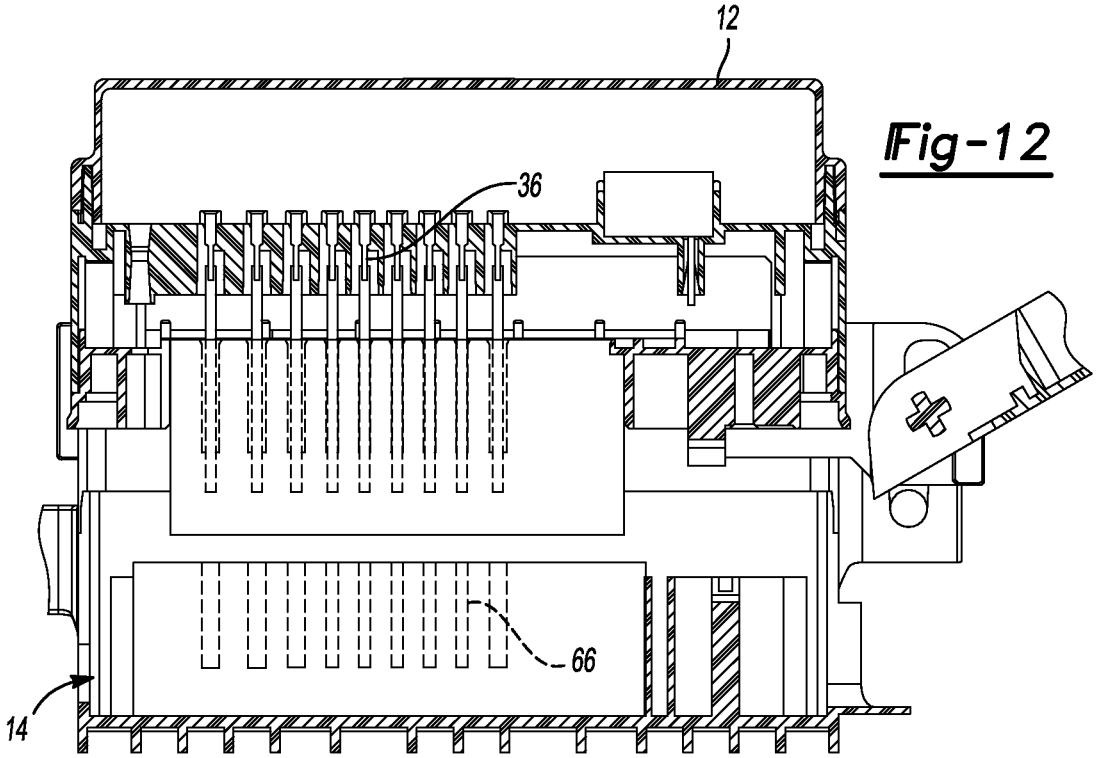
FIG. 12 is a section view taken along the line 12-12 of FIG. 10.

With reference to FIGS. 10 through 12, when the first and second connector portions 12 and 14 are disposed in the pre-stage position and the unlocking member 156 has unlocked the cam track lock 150 (FIG. 5) from the cam track housing 22, the lever 26 can be moved from the lowered position to the raised position to align the insertion portion 100 of the cam tracks 44 to the cam followers 62. Due to the weight of the first connector portion 12 and/or through the application of force onto the first connector portion 12 that tends to urge the first connector portion 12 toward the second connector portion 14 in the coupling direction, the first connector portion 12 can be urged toward the second connector portion 14 along the coupling axis 90 such that the cam followers 62 are received into the insertion portion 100 of the cam tracks 44.

Figure 13:
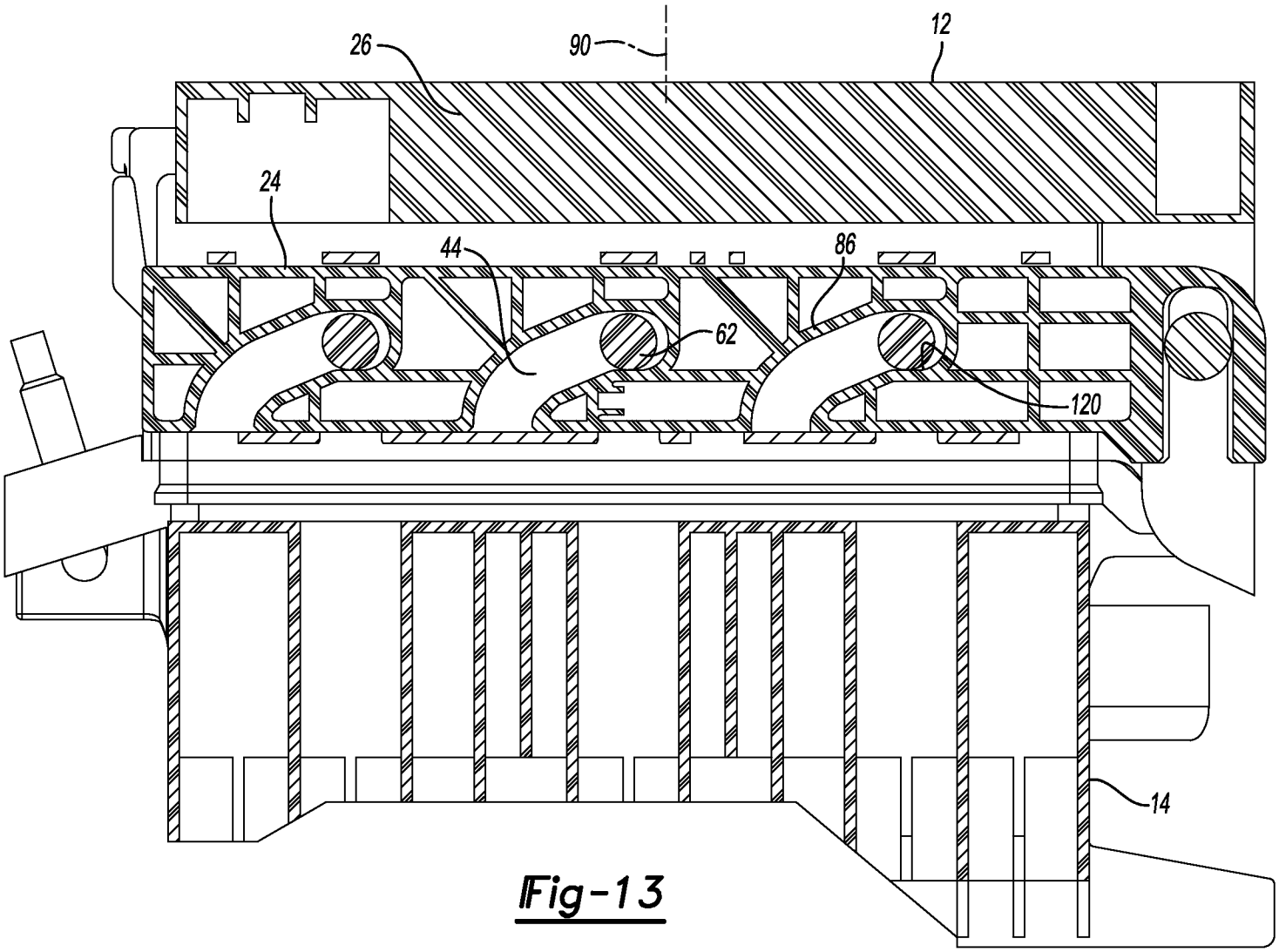
FIG. 13 is a section view taken along the line 13-13 of FIG. 1.

The lever 26 can be rotated from the raised position to the lowered position to move the cam track structures 24 from the extended position to the retracted position. The coupling side 84 of the cam tracks 44 can cooperate with the cam followers 62 to drive the first connector portion 12 in the coupling direction toward the second connector portion 14 along the coupling axis 90 to thereby drive the first terminals 36 into contact with the second terminals 66 to electrically connect and seat the first terminals 36 to the second terminals 66. FIGS. 1, 3 and 13 depict various views of the connector assembly 10 when the lever 26 is in the lowered position and the first terminals 36 are electrically connected to and seated against the second terminals 66.

Once coupled in this manner, the lever 26 can be rotated from the lowered position to the raised position to move the cam track structures 24 from the retracted position to the extended position. The decoupling side 86 of the cam tracks 44 can cooperate with the cam followers 62 to drive the first connector portion 12 in the decoupling direction away from the second connector portion 14 along the coupling axis 90 to thereby decouple the first terminals 36 from the second terminals 66.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A connector assembly comprising:

a first connector portion having a first connector housing, a pair of cam track structures and a lever, the first connector housing being adapted to support a plurality of first terminals, the cam track structures being slidably coupled to opposite sides of the first connector housing for movement between a retracted position and an extended position, each of the cam track structures having at least one cam track, the lever being pivotally coupled to the first connector housing for movement between a lowered position and a raised position, the lever being coupled to the cam track structures such that the cam track structures are in the retracted position when the lever is in the lowered position and the cam track structures are in the extended position when the lever is in the raised position; and a second connector portion having a second connector housing and a plurality of cam followers, the second connector housing being adapted to support a plurality of second terminals, each of the cam followers being fixedly coupled to the second connector housing and received in a corresponding one of the cam tracks;

wherein the cam tracks are configured to cooperate with the cam followers to draw the first connector housing toward the second connector housing when the lever is moved from the raised position to the lowered position, and wherein the cam tracks are configured to cooperate with the cam followers to urge the first connector housing away from the second connector housing when the lever is moved from the lowered position to the raised position, wherein the first connector portion comprises a cam track lock that cooperates with another portion of the first connector portion when the first connector portion is decoupled from the second connector portion to inhibit movement of at least one of the cam track structures from the retracted position toward the extended position to thereby inhibit movement of the lever from the lowered position toward the raised position.

2. The connector assembly of claim 1, wherein each of the cam track structures is slidably housed in a cam track housing.

3. The connector assembly of claim 2, wherein the another portion of the first connector portion comprises at least one of the cam track housings.

4. The connector assembly of claim 1, wherein the second connector housing comprises a rib that urges the cam track lock out of engagement with the another portion of the first connector portion.

5. The connector assembly of claim 4, wherein the rib is received into a slot in the first connector portion.

6. The connector assembly of claim 1, further comprising a keying system having a first key member and a second key member, the first key member being coupled to the first connector portion, the second key member being keyed to the second connector portion, the keying system being configured to cooperate with at least one of the first and second connector housings to permit insertion of the first connector housing to the second connector housing only when the first and second key members are engaged to one another.

7. The connector assembly of claim 1, wherein each cam follower is received into a corresponding one of the cam tracks along an insertion axis, wherein each cam track comprises a first transition portion and a second transition portion, wherein an included angle between the first transition portion and the insertion axis has a first magnitude, and wherein an included angle between the second transition portion and the insertion axis has a second, larger magnitude.

8. The connector assembly of claim 7, wherein the first transition portion is timed to occur when the first terminals begin to engage the second terminals.

9. The connector assembly of claim 1, wherein each cam track terminates at a back-angled portion, the back-angled portions cooperating with the cam followers to slightly withdraw the first terminals from the second terminals as the cam track structures are moved into the retracted position and to lock the cam track structures into the retracted position.

10. A method for installing a junction box assembly to a vehicle electrical system, the junction box assembly being a first connector portion and having a first connector housing, a pair of cam track structures and a lever, the first connector housing supporting a plurality of first terminals, the cam track structures being slidably coupled to opposite sides of the first connector housing for movement between a retracted position and an extended position, each of the cam track structures having at least one cam track, the lever being pivotally coupled to the first connector housing for movement between a lowered position and a raised position, the lever being coupled to the cam track structures such that the cam track structures are in the retracted position when the lever is in the lowered position and the cam track structures are in the extended position when the lever is in the raised position, the method comprising:

providing a second connector portion having a second connector housing and a plurality of cam followers;

inserting a plurality of wire harness connectors into the second connector housing, each of the wire harness connectors having a plurality of second terminals;

pre-staging the junction box assembly to the second connector portion such that the first connector housing is aligned to the second connector housing in a predetermined manner;

moving the lever from the lowered position to the raised position to align an insertion portion of each cam track to a corresponding one of the cam followers; and moving the lever from the raised position to the lowered position to drive the first connector housing toward the wire harness connectors and engage the first terminals to the second terminals, wherein pre-staging the junction box assembly to the second connector portion comprises de-activating a lock on the junction box assembly that inhibits sliding of at least one of the cam tracks from the retracted position, pivoting of the lever from the lowered position, or both.

11. The method of claim 10, wherein a keying system inhibits pre-staging the junction box assembly to the second connector portion if the first connector housing is not aligned to the second connector housing in the predetermined manner.

12. The method of claim 10, wherein the cam tracks are configured to cooperate with cam followers to vary an insertion force that is generated when the lever is moved from the raised position to the lowered position and a given input force is applied to the lever.

13. The method of claim 12, wherein the cam tracks cooperate with the cam followers to maximize the insertion force for a given input force during a portion of a stroke of the first terminals that includes engagement of the first terminals to the second terminals.

14. A connector assembly comprising:

a first connector portion having a plurality of first terminals, a first connector housing, a pair of cam track housings, a pair of cam track structures and a lever, the first terminals being coupled to the first connector housing, the cam track housings being coupled to opposite sides of the first connector housing, the cam track structures being slidably received in the cam track housings for movement between a retracted position and an extended position, each of the cam track structures having at least one cam track, the lever being pivotally coupled to the first connector housing for movement between a lowered position and a raised position, the lever being coupled to the cam track structures such that the cam track structures are in the retracted position when the lever is in the lowered position and the cam track structures are in the extended position when the lever is in the raised position;

a second connector portion having a second connector housing and a plurality of cam followers, the second connector housing being adapted to support a plurality of second terminals, each of the cam followers being received in a corresponding one of the cam tracks; and a keying system;

wherein the cam tracks are configured to cooperate with the cam followers to draw the first connector housing toward the second connector housing when the lever is moved from the raised position to the lowered position, and wherein the cam tracks are configured to cooperate with the cam followers to urge the first connector housing away from the second connector housing when the lever is moved from the lowered position to the raised position;

wherein the first connector portion comprises a cam track lock that cooperates with one of the cam track housings when the first connector portion is decoupled from the second connector portion to inhibit movement of at least one of the cam track structures from the retracted position toward the extended position to thereby inhibit movement of the lever from the lowered position toward the raised position;

wherein the second connector housing comprises a rib that urges the cam track lock out of engagement with the cam track housing; and wherein the keying system has a first key member and a second key member, the first key member being coupled to the first connector portion, the second key member being keyed to the second connector portion, the keying system being configured to cooperate with at least one of the first and second connector housings to permit insertion of the first connector housing to the second connector housing only when the first and second key members are engaged to one another.

15. The connector assembly of claim 14, wherein the rib is received into a slot in the cam track housing.

16. The connector assembly of claim 14, wherein each cam follower is received into a corresponding one of the cam tracks along an insertion axis, wherein each cam track comprises a first transition portion and a second transition portion, wherein an included angle between the first transition portion and the insertion axis has a first magnitude, and wherein an included angle between the second transition portion and the insertion axis has a second, larger magnitude.

17. The connector assembly of claim 16, wherein the first transition portion is timed to occur when the first terminals begin to engage the second terminals.

18. The connector assembly of claim 14, wherein each cam track terminates at a back-angled portion, the back-angled portions cooperating with the cam followers to slightly withdraw the first terminals from the second terminals as the cam track structures are moved into the retracted position and to lock the cam track structures into the retracted position.

* * * * *